US005991725A

United States Patent [19]

Asghar et al.

[11] Patent Number: 5,991,725

[45] **Date of Patent: *Nov. 23, 1999**

[54] SYSTEM AND METHOD FOR ENHANCED SPEECH QUALITY IN VOICE STORAGE AND RETRIEVAL SYSTEMS

[75] Inventors: Saf Asghar; Mark Ireton, both of Austin, Tex.

[73] Assignee: Advanced Micro Devices, Inc., Sunnyvale, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/399,497

[22] Filed: Mar. 7, 1995

[51] Int. Cl.[6] ..... G10L 9/00

[52] U.S. Cl. ..... 704/270; 704/230; 704/201

[58] Field of Search ..... 395/2.1, 2.12, 395/2.17, 2.2, 2.24, 2.28, 2.35, 2.38, 2.39; 704/201, 203, 208, 211, 215, 219, 226, 229, 230, 270

[56] References Cited

U.S. PATENT DOCUMENTS

| | | | |
|---|---|---|---|
| 4,121,058 | 10/1978 | Jusko et al. | 179/15.55 T |
| 4,639,920 | 1/1987 | Kaneko | 371/31 |
| 4,641,238 | 2/1987 | Kneib | 364/200 |
| 4,817,157 | 3/1989 | Gerson | 395/2.31 |

(List continued on next page.)

FOREIGN PATENT DOCUMENTS

| | | |
|---|---|---|
| 0459358A2 | 5/1991 | European Pat. Off. . |
| 0459358B1 | 10/1995 | European Pat. Off. . |

OTHER PUBLICATIONS

Lefevre, J.P., and Feng, G., "Some Features Able To Improve The Performance Of A LPC Synthesizer", XP000079206, Signal Processing IV, Grenoble: Theories and Applications, J.L. Caoume et al, Editors, Elsevier Science Publishers B.V. (North–Holland), EURASIP, 1988, pp. 155–158.

Jayant, N.S., "Average—and Median–Based Smoothing Techniques for Improving Digital Speech Quality in the Presence of Transmission Errors", XP002051208, Concise Papers, pp. 1043–1045, IEEE Transactions on Communications, Sep. 1976, U.S.A., vol. COM–24, No. 9, pp. 1043–1045.

*Primary Examiner*—David R. Hudspeth
*Assistant Examiner*—Michael N. Opsasnick
*Attorney, Agent, or Firm*—Conley, Rose & Tayon, P.C.; Jeffrey C. Hood; Eric A. Stephenson

[57] ABSTRACT

A digital voice data storage and retrieval system using a low bit rate encoder which provides enhanced speech signal quality while also reducing memory size requirements. The system comprises a voice coder/decoder which preferably includes a digital signal processor (DSP) and also preferably includes a local memory. During encoding of the voice data, the voice coder/decoder receives voice input waveforms and generates a parametric representation of the voice data. A storage memory is coupled to the voice coder/decoder for storing the parametric data. During decoding of the voice data, the voice coder/decoder receives the parametric data from the storage memory and reproduces the voice waveforms. According to the invention, an interframe smoothing method is performed on the parametric data after encoding of all of the speech data has completed and the parametric data has been stored in the storage memory. The interframe smoothing is performed either in the background after the coding process has completed or in real time during the decoding process immediately prior to converting the parametric data back to signal waveforms. Since all of the voice input data has already been converted to parametric data and stored in memory, parametric data from a virtually unlimited number of prior and successive frames is available for use by the smoothing algorithm. Therefore, the present invention provides more accurate smoothing and provides enhanced speech signal quality over prior systems.

44 Claims, 9 Drawing Sheets

U.S. PATENT DOCUMENTS

| | | | |
|---|---|---|---|
| 4,918,729 | 4/1990 | Kudoh | 395/2.28 |
| 5,031,218 | 7/1991 | Galand et al. | 381/46 |
| 5,148,487 | 9/1992 | Nagai et al. | 395/2.32 |
| 5,291,286 | 3/1994 | Murakami et al. | 348/469 |
| 5,305,332 | 4/1994 | Ozawa | 395/2.28 |
| 5,327,520 | 7/1994 | Chen | 395/2.28 |
| 5,357,594 | 10/1994 | Fielder | 395/2.2 |
| 5,386,493 | 1/1995 | Degen et al. . | |
| 5,471,558 | 11/1995 | Tsutsui | 395/2.28 |
| 5,479,559 | 12/1995 | Fette et al. | 704/207 |
| 5,491,771 | 2/1996 | Gupta et al. | 395/2.32 |
| 5,504,833 | 4/1996 | George et al. | 395/2.12 |
| 5,568,514 | 10/1996 | McCree | 395/2.39 |
| 5,577,159 | 11/1996 | Shoham | 395/2.15 |
| 5,657,420 | 8/1997 | Jacobs et al. | 704/223 |
| 5,673,361 | 9/1997 | Ireton | 704/469 |

RANGE OF BIT RATES FOR VARIOUS TYPES OF SPEECH REPRESENTATIONS.

SOURCE-SYSTEM MODEL OF SPEECH PRODUCTION.

SYSTEM AND METHOD FOR ENHANCED SPEECH QUALITY IN VOICE STORAGE AND RETRIEVAL SYSTEMS

FIELD OF THE INVENTION

The present invention relates generally to voice storage and retrieval systems, and more particularly to a system and method for performing parameter smoothing operations after the encoding process has completed to allow access to parameters in a greater number of frames and thus provide enhanced speech quality with reduced memory requirements.

DESCRIPTION OF THE RELATED ART

Digital storage and communication of voice or speech signals has become increasingly prevalent in modem society. Digital storage of speech signals comprises generating a digital representation of the speech signals and then storing those digital representations in memory. As shown in FIG. 1, a digital representation of speech signals can generally be either a waveform representation or a parametric representation. A waveform representation of speech signals comprises preserving the "waveshape" of the analog speech signal through a sampling and quantization process. A parametric representation of speech signals involves representing the speech signal as a plurality of parameters which affect the output of a model for speech production. A parametric representation of speech signals is accomplished by first generating a digital waveform representation using speech signal sampling and quantization and then further processing the digital waveform to obtain parameters of the model for speech production. The parameters of this model are generally classified as either excitation parameters, which are related to the source of the speech sounds, or vocal tract response parameters, which are related to the individual speech sounds.

FIG. 2 illustrates a comparison of the waveform and parametric representations of speech signals according to the data transfer rate required. As shown, parametric representations of speech signals require a lower data rate, or number of bits per second, than waveform representations. A waveform representation requires from 15,000 to 200,000 bits per second to represent and/or transfer typical speech, depending on the type of quantization and modulation used. A parametric representation requires a significantly lower number of bits per second, generally from 500 to 15,000 bits per second. In general, a parametric representation is a form of speech signal compression which uses a priori knowledge of the characteristics of the speech signal in the form of a speech production model. A parametric representation represents speech signals in the form of a plurality of parameters which affect the output of the speech production model, wherein the speech production model is a model based on human speech production anatomy.

Speech sounds can generally be classified into three distinct classes according to their mode of excitation. Voiced sounds are sounds produced by vibration or oscillation of the human vocal cords, thereby producing quasi-periodic pulses of air which excite the vocal tract. Unvoiced sounds are generated by forming a constriction at some point in the vocal tract, typically near the end of the vocal tract at the mouth, and forcing air through the constriction at a sufficient velocity to produce turbulence. This creates a broad spectrum noise source which excites the vocal tract. Plosive sounds result from creating pressure behind a closure in the vocal tract, typically at the mouth, and then abruptly releasing the air.

A speech production model can generally be partitioned into three phases comprising vibration or sound generation within the glottal system, propagation of the vibrations or sound through the vocal tract, and radiation of the sound at the mouth and to a lesser extent through the nose. FIG. 3 illustrates a simplified model of speech production which includes an excitation generator for sound excitation or generation and a time varying linear system which models propagation of sound through the vocal tract and radiation of the sound at the mouth. Therefore, this model separates the excitation features of sound production from the vocal tract and radiation features. The excitation generator creates a signal comprised of either a train of glottal pulses or randomly varying noise. The train of glottal pulses models voiced sounds, and the randomly varying noise models unvoiced sounds. The linear time-varying system models the various effects on the sound within the vocal tract. This speech production model receives a plurality of parameters which affect operation of the excitation generator and the time-varying linear system to compute an output speech waveform corresponding to the received parameters.

Referring now to FIG. 4, a more detailed speech production model is shown. As shown, this model includes an impulse train generator for generating an impulse train corresponding to voiced sounds and a random noise generator for generating random noise corresponding to unvoiced sounds. One parameter in the speech production model is the pitch period, which is supplied to the impulse train generator to generate the proper pitch or frequency of the signals in the impulse train. The impulse train is provided to a glottal pulse model block which models the glottal system. The output from the glottal pulse model block is multiplied by an amplitude parameter and provided through a voiced/unvoiced switch to a vocal tract model block. The random noise output from the random noise generator is multiplied by an amplitude parameter and is provided through the voiced/unvoiced switch to the vocal tract model block. The voiced/unvoiced switch is controlled by a parameter which directs the speech production model to switch between voiced and unvoiced excitation generators, i.e., the impulse train generator and the random noise generator, to model the changing mode of excitation for voiced and unvoiced sounds.

The vocal tract model block generally relates the volume velocity of the speech signals at the source to the volume velocity of the speech signals at the lips. The vocal tract model block receives various vocal tract parameters which represent how speech signals are affected within the vocal tract. These parameters include various resonant and unresonant frequencies, referred to as formants, of the speech which correspond to poles or zeroes of the transfer function V(z). The output of the vocal tract model block is provided to a radiation model which models the effect of pressure at the lips on the speech signals. Therefore, FIG. 4 illustrates a general discrete time model for speech production. The various parameters, including pitch, voice/unvoice, amplitude or gain, and the vocal tract parameters affect the operation of the speech production model to produce or recreate the appropriate speech waveforms.

Referring now to FIG. 5, in some cases it is desirable to combine the glottal pulse, radiation and vocal tract model blocks into a single transfer function. This single transfer function is represented in FIG. 5 by the time-varying digital filter block. As shown, an impulse train generator and random noise generator each provide outputs to a voiced/unvoiced switch. The output from the switch is provided to a gain multiplier which in turn provides an output to the time-varying digital filter. The time-varying digital filter performs the operations of the glottal pulse model block, vocal tract model block and radiation model block shown in FIG. 4.

The choice of speech signal representation typically depends on the speech application involved. Various types of digital speech applications include digital storage and retrieval of speech data, digital transmission of speech signals, speech synthesis, speaker verification and identification, speech recognition, and enhancement of signal quality, among others. Most speech communication and recognition applications require real time encoding and transmission of speech signals. However, certain digital speech applications, i.e., those which involve digital storage and retrieval of speech data, do not require real time transmission. For example, the storage and retrieval of digital speech signals in answering machine, voice mail, and digital recorder applications do not require real time transmission of speech signals.

Background on voice encoding and decoding methods which use parametric representations of speech signals is deemed appropriate. A speech storage system first receives input voice waveforms and converts the waveforms to digital format. This involves sampling and quantizing the signal waveform into digital form. The voice encoder within the system then partitions the digital voice data into respective frames and analyzes the voice data on a frame-by-frame basis. The voice encoder generates a plurality of parameters which describe each particular frame of the digital voice data.

After parameters have been calculated for a plurality of frames, a smoothing method is typically applied to the parameters in each frame to smooth out discontinuities and thus eliminate errors in the parameter estimation process. In general, many parameters of a speech signal waveform, pitch for example, vary relatively slowly in time. Therefore, a parameter that varies substantially from one frame to the next may constitute an error in the parameter estimation method. The smoothing method operates by examining like parameters in respective neighboring frames to detect discontinuities. In other words, the smoothing algorithm compares the value of the respective parameter being examined with like parameters in one or more prior frames and one or more subsequent frames to determine whether the value of the respective parameter varies substantially from the values of the same or like parameter in neighboring frames. If one parameter significantly varies from neighboring like parameters in prior and subsequent frames, the smoothing method smoothes out the discontinuity, i.e., replaces the parameter value with a neighboring value. Therefore, smoothing is applied to smooth changes among parameters between consecutive frames and thus reduce errors in the parameter estimation process. Smoothing may involve examining related parameters in context in order to more accurately estimate the parameters. For example, the voicing and pitch parameters are analyzed to ensure that a valid pitch parameter is obtained only if the speech waveform is voiced, and vice versa.

In prior art systems, smoothing is performed in real time on a set of parameters during the encoding process after the set of parameters has been generated and prior to storing these parameters in the storage memory. However, in most applications the encoding of speech signals into a digital parametric representation must be performed in real time with minimal delay. In fact, most speech communication standards severely limit the amount of delay that can be imposed in a voice transmission. This requirement of real time encoding of speech data limits the number of frames which can be used in the smoothing process. In addition, maintaining a plurality of prior and subsequent frames in the memory used by the encoder requires increased memory size in the encoder and thus increases the cost of the system.

As mentioned above, certain digital speech applications, such as digital voice storage and retrieval systems, do not require real time transmission of speech data. Digital speech storage and retrieval applications generally require a low bit rate for the necessary voice coding and decoding in order to compress the speech data as much as possible. However, it is also desirable to provide quality voice reproduction at this low bit rate. It is also generally desirable to reduce the memory requirements for digital encoding, storage, and decoding in order to reduce system cost.

Therefore, an improved system and method for digital voice storage and retrieval is desired which provides enhanced speech signal quality in low bit rate speech encoders while also reducing memory requirements.

SUMMARY OF THE INVENTION

The present invention comprises a digital voice data storage and retrieval system, preferably using a low bit rate encoder, which provides enhanced speech signal quality while also reducing memory size requirements. The system comprises a voice coder/decoder which preferably includes a digital signal processor (DSP) and also preferably includes a local memory. During encoding of the voice data, the voice coder/decoder receives voice input waveforms and generates a parametric representation of the voice data. A storage memory is coupled to the voice coder/decoder for storing the parametric data. During decoding of the voice data, the voice coder/decoder receives the parametric data from the storage memory and reproduces the voice waveforms. A CPU is preferably coupled to the voice coder/decoder for controlling the operations of the voice coder/decoder.

During the coding process, voice input waveforms are received and converted into digital data, i.e., the voice input waveforms are sampled and quantized to produce digital voice data. The digital voice data is then partitioned into a plurality of respective frames, and coding is performed on respective frames to generate a parametric representation of the data, i.e., to generate a plurality of parameters which describe the respective frames of voice data. In one embodiment, smoothing is not performed during the encoding process, but rather the unsmoothed or "raw" parameter data is stored for the respective frames. In another embodiment, for certain parameters a plurality of parameter values are estimated for each frame, and intraframe smoothing is performed to generate a single parameter for the frame. The intraframe smoothing process performed during encoding does not require parametric data in prior or successive frames for comparison and thus requires little or no additional memory.

According to the invention, an interframe smoothing method is performed on the parametric data after encoding of all of the speech data has completed and the parametric data has been stored in the storage memory. The interframe smoothing is performed either in the background after the coding process has completed or in real time during the decoding process immediately prior to converting the parametric data back to signal waveforms. Since all of the voice input data has already been converted to parametric data and stored in memory, parametric data from a virtually unlimited number of prior and successive frames is available for use by the smoothing algorithm. Thus, the smoothing method preferably utilizes the parameter values of a plurality of prior and subsequent frames in smoothing parameters in each respective frame. Therefore, the present invention provides more accurate smoothing and provides enhanced speech signal quality over prior systems.

As discussed in the background section, prior art systems perform smoothing in real time during the encoding process and are generally limited to examining like parameter values in a single prior and successive frame due to the necessity of real time voice encoding. However, in the present invention the smoothing method is performed after the encoding process has completed and the parametric data has been stored. Since all of the parametric data is readily available, the smoothing method examines parametric data from a far greater number of prior and successive frames. Therefore, the system can more easily detect transitions and/or correct discontinuities that occur in the speech signal data. This provides enhanced speech signal quality over prior art methods. Also, since interframe smoothing is not performed during encoding, extra memory is not required for a successive or look-ahead frame during the encoding process. Therefore, the present invention has reduced memory requirements over prior designs.

In the preferred embodiment, during the smoothing process the system of the present invention stores parametric data in respective buffers in the DSP local memory, preferably circular buffers, where each circular buffer stores like parameters for a plurality of consecutive frames. In other words, parameter values of a first parameter type from a plurality of consecutive frames are stored in a first circular buffer, parameter values of a second parameter type from a plurality of consecutive frames are stored in a second circular buffer, and so on. Therefore, during smoothing the DSP local memory comprises a plurality of circular buffers with each circular buffer containing parameters of the same type for a plurality of consecutive frames. New parameter values are continually read into each circular buffer to maintain parameter data for respective prior and successive frames relative to the frame containing the parameter being examined.

In one embodiment, parameter values from seventeen consecutive frames are stored in each circular buffer. These seventeen frames correspond to the eight prior and eight successive frames relative to the frame containing the parameter being examined. In an alternate embodiment, the circular buffers vary in size for respective parameters, and thus a different number of like parameters are examined during the smoothing process for different types of parameters. In addition, in one embodiment, if the DSP decides that an even greater number of parameters from additional prior and subsequent frames are necessary to reach a decision in the smoothing process, the DSP reads these additional parameters from the storage memory to perform more intelligent smoothing of that respective parameter. In yet another embodiment, only the respective parameters deemed to be the most important parameters and/or the most likely to be estimated improperly are stored in the memory local to the digital processor in order to reduce local memory requirements and simplify the smoothing process. The parameters not stored in the local memory are read from the random access storage memory as needed.

Therefore, a digital voice storage and retrieval system according to the present invention provides enhanced speech signal quality. Particular embodiments are shown and described.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Voice Storage and Retrieval System

Figure 6:
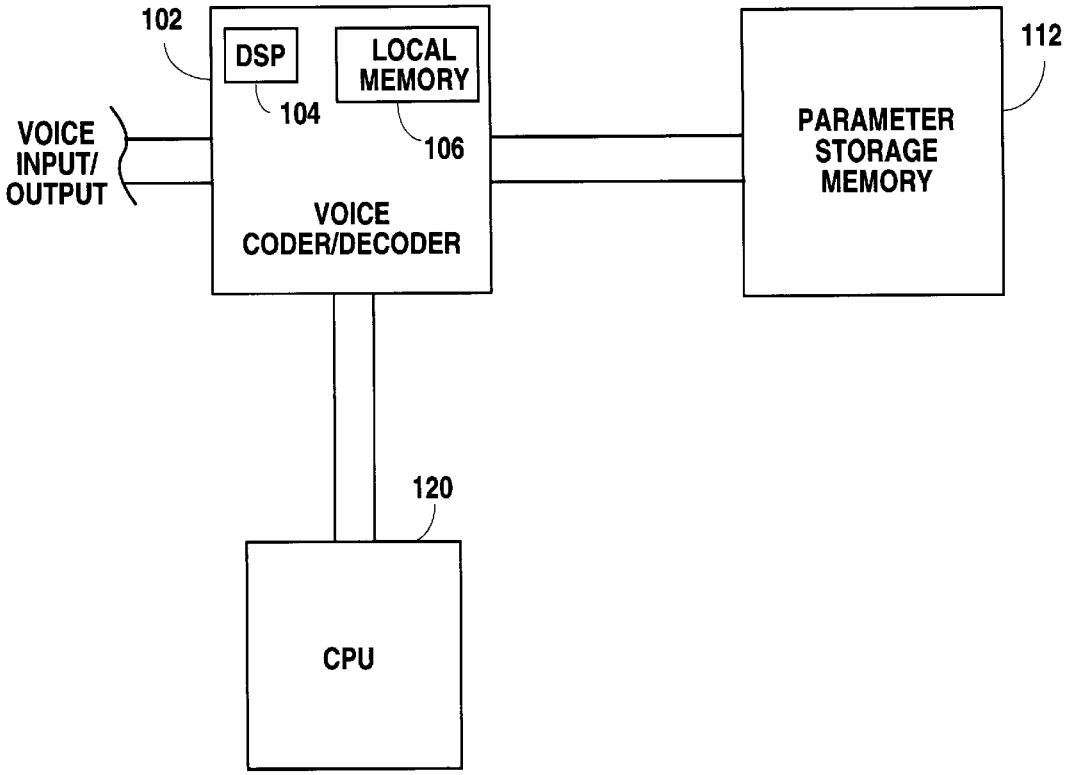
FIG. 6 is a block diagram of a speech storage system which includes a voice codec coupled to a parameter storage memory, and also includes a CPU coupled to the voice codec according to one embodiment of the present invention.

Referring now to FIG. 6, a block diagram illustrating a voice storage and retrieval system according to one embodiment of the invention is shown. The voice storage and retrieval system shown in FIG. 6 can be used in various applications, including digital answering machines, digital voice mail, digital voice recorders, and other applications which require storage and retrieval of digital voice data. In the preferred embodiment, the voice storage and retrieval system is used in a digital answering machine. It is also noted that the present invention may be used in other systems which involve the storage and retrieval of parametric data, including video storage and retrieval systems, among others.

As shown in FIG. 6, the voice storage and retrieval system preferably includes a dedicated voice coder/decoder 102. The voice coder/decoder 102 includes a digital signal processor (DSP) 104 and local DSP memory 106. The local memory 106 serves as an analysis memory used by the DSP 104 in performing voice coding and decoding functions, i.e., voice compression and decompression, as well as parameter data smoothing. The local memory 106 operates at a speed equivalent to the DSP 104 and thus has a relatively fast access time. Since the local memory 106 is required to have a fast access time, the memory 106 is relatively costly. One benefit of the present invention is that the invention has reduced local memory requirements while also providing enhanced speech quality. In the preferred embodiment, 2 Kbytes of local memory 106 are used.

The voice coder/decoder 102 is coupled to a parameter storage memory 112. The storage memory 112 is used for storing coded voice parameters corresponding to the received voice input signal. In one embodiment, the storage memory 112 is preferably low cost (slow) dynamic random access memory (DRAM). However, it is noted that the storage memory 112 may comprise other storage media, such as a magnetic disk, flash memory, or other suitable storage media. A CPU 120 is coupled to the voice coder/decoder 102 and controls operations of the voice coder/decoder 102, including operations of the DSP 104 and the DSP local memory 106 within the voice coder/decoder 102. The CPU 120 also performs memory management functions for the voice coder/decoder 102 and the storage memory 112.

Alternate Embodiment

Figure 7:
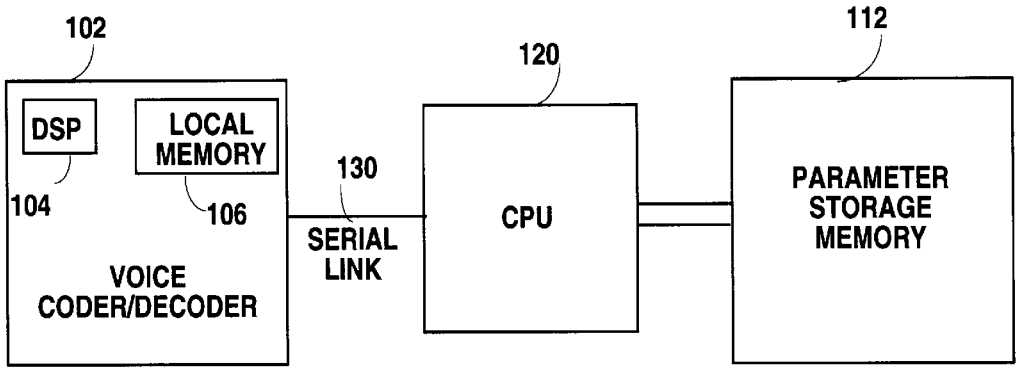
FIG. 7 is a block diagram of a speech storage system which includes a voice codec coupled through a serial link to a CPU, which in turn is coupled to a parameter storage memory according to a second embodiment of the present invention.

Referring now to FIG. 7, an alternate embodiment of the voice storage and retrieval system is shown. Elements in FIG. 7 which correspond to elements in FIG. 6 have the same reference numerals for convenience. As shown, the voice coder/decoder 102 couples to the CPU 120 through a serial link 130. The CPU 120 in turn couples to the parameter storage memory 112 as shown. The serial link 130 may comprise a dumb serial bus which is only capable of providing data from the storage memory 112 in the order that the data is stored within the storage memory 112. Alternatively, the serial link 130 may be a demand serial link, where the DSP 104 controls the demand for parameters in the storage memory 112 and randomly accesses desired parameters in the storage memory 112 regardless of how the parameters are stored. The embodiment of FIG. 7 can also more closely resemble the embodiment of FIG. 6 whereby the voice coder/decoder 102 couples directly to the storage memory 112 via the serial link 130. In addition, a higher bandwidth bus, such as an 8-bit or 16-bit bus, may be coupled between the voice coder/decoder 102 and the CPU 120.

Encoding Voice Data

Figure 8:
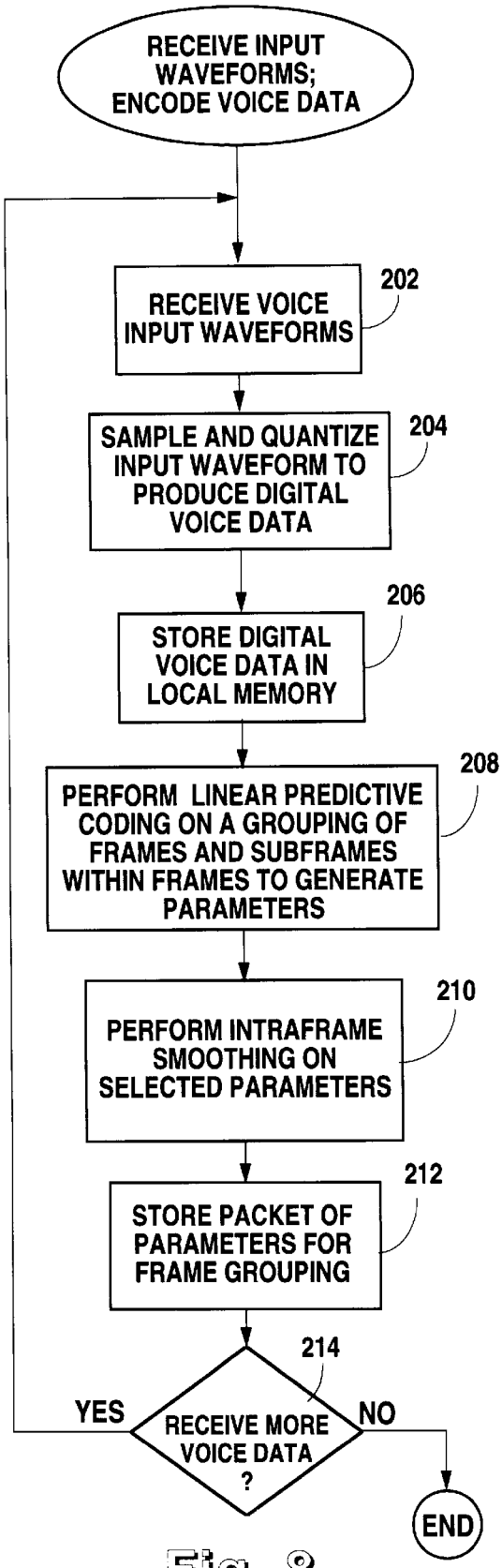
FIG. 8 is a flowchart diagram illustrating operation-of the speech signal encoding which includes the generation of speech parameters, intraframe smoothing of speech parameters, and storage of speech parameters according to one embodiment of the present invention.

Referring now to FIG. 8, a flowchart diagram illustrating operation of the system of FIG. 6 encoding voice or speech signals into parametric data is shown. In step 202 the voice coder/decoder 102 receives voice input waveforms, which are analog waveforms corresponding to speech. These waveforms will typically resemble the waveforms shown in FIG. 9.

In step 204 the DSP 104 samples and quantizes the input waveforms to produce digital voice data. The DSP 104 samples the input waveform according to a desired sampling rate. In one embodiment, the speech signal waveform is sampled at a rate of 8 kHz or 8000 samples per second. In an alternate embodiment, the sampling rate is twice the Nyquist sampling rate. Other sampling rates may be used, as desired. After sampling, the speech signal waveform is then quantized into digital values using a desired quantization method. In step 206 the DSP 104 stores the digital voice data or digital waveform values in the local memory 106 for analysis by the DSP 104.

While additional voice input data is being received, sampled, quantized, and stored in the local memory 106 in steps 202–206, the following steps are performed. In step 208 the DSP 104 performs encoding on a grouping of frames of the digital voice data to derive a set of parameters which describe the voice content of the respective frames being examined. In the preferred embodiment, linear predictive coding is performed on groupings of four frames. However, it is noted that other types of coding methods may be used, as desired. Also, a greater or lesser number of frames may be encoded at a time, as desired. For more information on digital processing and coding of speech signals, please see Rabiner and Schafer, *Digital Processing of Speech Signals,* Prentice Hall, 1978, which is hereby incorporated by reference in its entirety.

Figure 9:
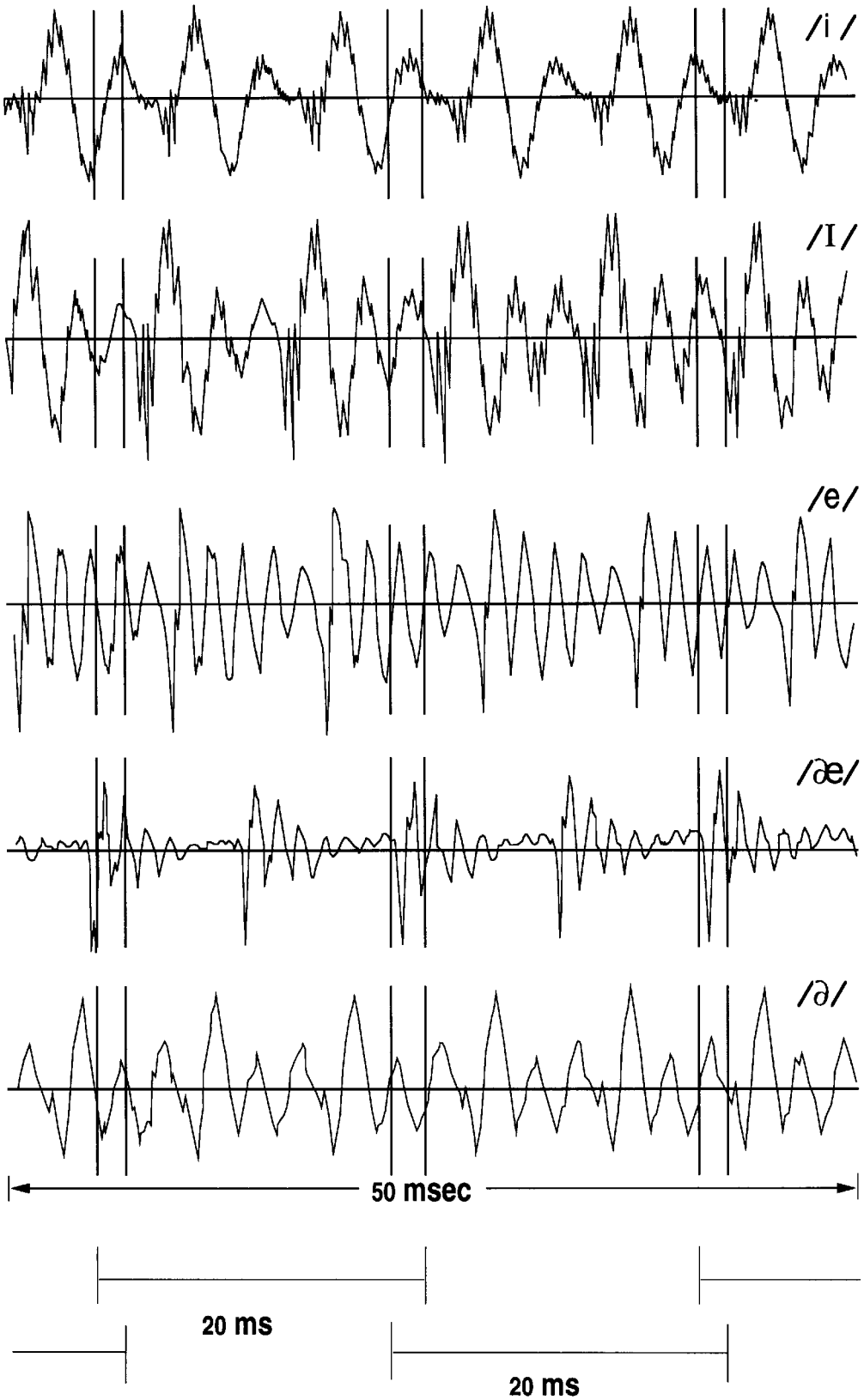
FIG. 9 illustrates speech signal waveforms partitioned into partially overlapping twenty millisecond samples.

The DSP 104 preferably examines the speech signal waveform in 20 ms frames for analysis and coding into respective parameters. With a sampling rate of 8 kHz, each ms frame comprises 160 samples of data. The DSP 104 preferably examines four 20 ms frames at a time where each frame overlaps neighboring frames by five samples on either side, as shown in FIG. 9. The local memory 106 is preferably sufficiently large to store up to six full frames of digital voice data. This allows the DSP 104 to examine a grouping of four frames and generate parameters for this grouping of four frames while up to an additional two frames are received, sampled, quantized and stored in the local memory 106. The local memory 106 is preferably configured as one or more buffers, preferably circular buffers, where newly received digital voice data overwrites voice data from which parameters have already been generated and stored in the storage memory 112. It is noted that the local memory 106 may be any of various types of memory, including registers, linear buffers, or circular buffers, among others.

In step 208 the DSP 104 develops a set of parameters of different types for each 20 ms frame in the grouping of four frames. The DSP 104 also generates one or more parameters which span the entire four frames. In addition, for certain parameters, the DSP 104 partitions the respective frames into two or more sub-frames and generates corresponding two or more parameters of the same type for each frame. In the preferred embodiment, the DSP 104 generates ten linear predictive coding (1pc) parameters for every four frames. The DSP 104 also generates additional parameters for each frame which represent the characteristics of the speech signal, including a pitch parameter, a voice/unvoice parameter, a gain parameter, a magnitude parameter, and a multiband excitation parameter. The DSP 104 further generates a set of spectral content parameters computed for each frame which are quantized into one value across a grouping of frames, preferably three frames.

Once these parameters have been generated in step 208, in step 210 the DSP 104 optionally performs intraframe smoothing on selected parameters. In an embodiment where intraframe smoothing is performed, a plurality of parameters of the same type are generated for each frame in step 208. Intraframe smoothing is applied in step 210 to reduce these plurality of parameters of the same type to a single parameter of that type. For example, a plurality of different pitch parameter values are calculated at different points in a frame for each frame in step 208, and in step 210 intraframe smoothing is performed to reduce these twenty pitch parameter values to a single pitch value representative of the entire frame. Intraframe smoothing preferably involves selecting a mean or median value. Alternatively, intraframe smoothing involves developing a waveform based on the plurality of parameter values in the frame and then using this developed waveform to index into a listing of parameter values based on this waveform. Intraframe smoothing is generally performed on those parameters which are more likely to vary within a frame. However, as noted above, the intraframe smoothing performed in step 210 is an optional step which may or may not be performed, as desired.

Once the coding has been performed on the respective grouping of frames to produce parameters in step 208, and any desired intraframe smoothing has been performed on selected parameters in step 210, the DSP 104 stores this packet of parameters in the storage memory 112 in step 212. Once parametric data corresponding to a respective grouping of frames has been generated and stored in the storage memory 112, newly received data eventually overwrites this data in the circular buffer in step 206, and thus the digital voice data for this grouping of frames is removed from the local memory 106 and hence "thrown away."

If more speech waveform data is being received by the voice coder/decoder 102 in step 214, then operation returns to step 202, and steps 202–214 are repeated. Thus, once a set of parameters has been generated for a grouping of frames and stored in the storage memory 112, the DSP 104 examines the next grouping of frames stored in local memory 106 and generates a plurality of parameters for this grouping, and so on. If no more voice data is determined to have been received in step 214, and thus no more digital voice data is stored in the local memory 106, then operation completes.

Voice coding is performed in real time as the voice signal is received by the voice coder/decoder 102. In the preferred embodiment, a system according to the present invention compresses the voice data to approximately 2900 bits per second (bps) of speech, which is approximately one-third of a bit per sample. More or less compression may be applied to the voice data, as desired.

It is noted that prior art systems perform an additional interframe smoothing process on the parameter data generated by the DSP 104 in real time prior to storing the parameter data in the storage memory 112. As discussed in the background section, when interframe smoothing is implemented in the encoding process, the system is only able to examine the same or like parameters in one subsequent and one prior frame for each parameter being examined. However, it would generally be desirable to examine like parameters in a plurality of subsequent and prior frames to perform more accurate smoothing. This is generally not possible during real time encoding because significant delays would be added to the voice coding process. This is unacceptable for most voice data transmission standards. In addition, in systems which perform interframe smoothing during the encoding process, the voice coder/decoder 102 is required to have a larger local memory 106 for storing additional frames of voice parameter data. In cost sensitive systems, this additional memory is undesirable.

In applications that do not require real time transmission of voice data, it has been determined that is undesirable and unnecessary to perform an interframe smoothing process in real time during the voice coding process. Rather, the system and method of the present invention performs interframe smoothing operations either in the background after voice parameter data has been coded and stored in the storage memory 112, or interframe smoothing operations are performed in real time during the voice decoding process. After the coding process has completed, i.e., after all of the voice waveforms have been received, converted into parametric data, and stored in the storage memory 112, all of the parametric data is readily available in the storage memory 112 for use during the smoothing process. Therefore, parametric data from an unlimited number of prior and subsequent frames is available for use by the smoothing method. Thus, more accurate smoothing can be performed on each parameter since a greater number of like parameters in prior and subsequent frames are available. In addition, a system according to the present invention requires reduced local memory since parametric data for a look-ahead frame or subsequent frame is no longer required to be stored in the local memory 106 during the encoding process.

Smoothing Performed in Background

Figure 10:
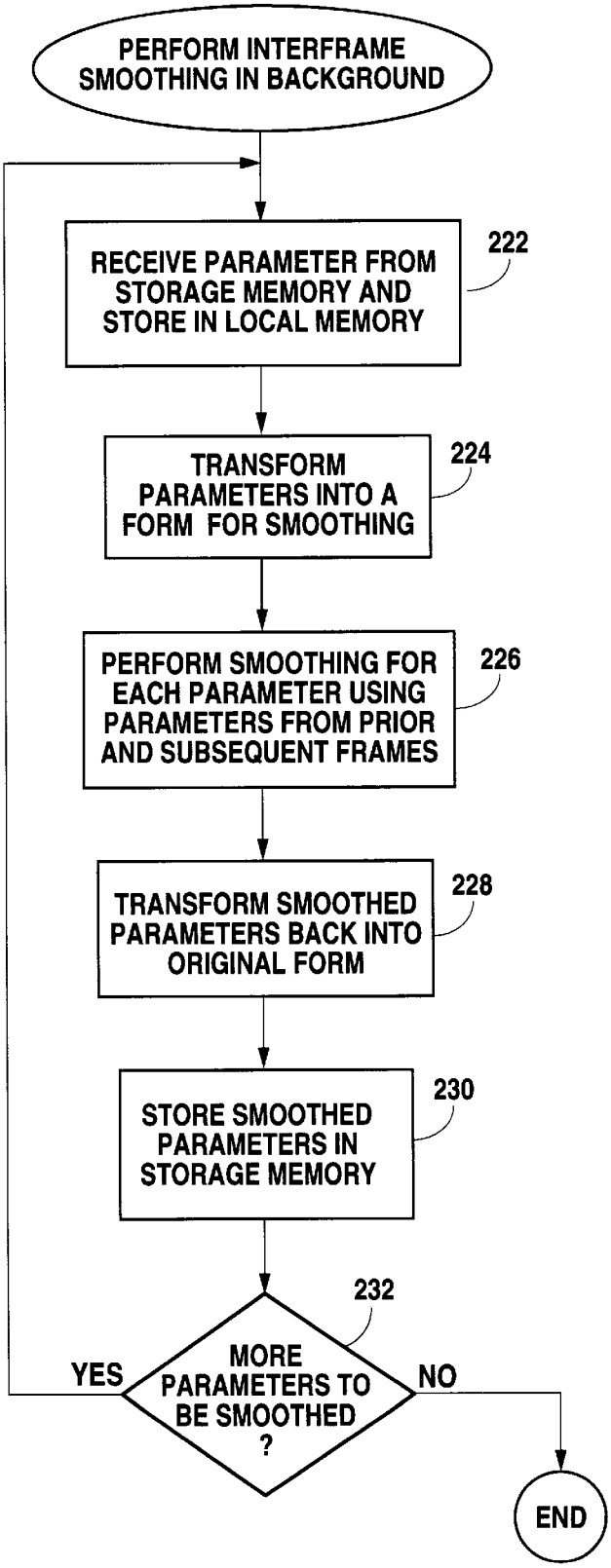
FIG. 10 is a flowchart diagram illustrating an interframe smoothing process performed in the background after encoding of the digital voice data has completed according to one embodiment of the invention.

FIG. 10 is a flowchart diagram illustrating smoothing operations being performed in the background after encoding of the voice data has completed and all of the parametric data has been stored in the storage memory 112 according to one embodiment of the present invention. As mentioned above, in applications which do not require real time voice data transmission, smoothing operations can be performed after the voice data has been coded into parametric data and prior to retrieval of the parametric data, i.e., in the background. Examples of applications where smoothing operations can be performed in the background include digital voice answering machines, digital tape recorders and other voice storage and retrieval systems. For example, in a digital answering machine application, after the caller has left a message on the answering machine and the voice data has been coded and stored in the storage memory 112, the DSP 104 performs smoothing operations on the parametric data and then rewrites the smoothed parametric data back to the storage memory 112 any time before the message is listened to.

As shown in FIG. 10, in step 222 the voice coder/decoder 102 receives parameters from multiple consecutive frames and stores like parameters from each of the plurality of frames in respective circular buffers in the local memory 106. In other words, the same or like parameters from each of the frames are stored in respective circular buffers. Thus, all of the pitch parameters for each of the consecutive frames are stored in one circular buffer, the voice/unvoice parameters for each of the consecutive frames are stored in a second circular buffer, and so on. In the preferred embodiment, like parameters from seventeen frames are preferably stored in each circular buffer to allow a parameter to be examined in the context of its neighboring parameters from the eight prior and eight subsequent frames. This allows much more accurate smoothing and allows for enhanced speech signal quality while using low bit rate coders.

In an alternate embodiment, a different number of like parameters are stored in each circular buffer for each type of parameter. In other words, the circular buffers vary in size depending on the parameter type, and thus certain parameters use a greater number of like parameters from prior and subsequent frames in the smoothing process than do others. In this embodiment, the number of like parameters stored in a respective circular buffer, i.e., the size of the circular buffer for a respective parameter, depends on the number of parameters in prior and subsequent frames required for the smoothing process to accurately smooth the particular parameter. Thus, if a certain parameter requires analysis of a greater number of parameters in prior and subsequent frames for accurate smoothing, such as the voice/unvoice parameter, a larger circular buffer is used for this parameter.

In step 224 the DSP 104 transforms the received parameters in a form more suitable for smoothing. For example, if a certain parameter is stored in a difference format where each parameter in a frame is stored as a difference value based on the respective parametric value and the value of the parameter in the prior frame, this step transforms each of the parameters into a normal or more intelligible format, where each value represents the true value of the parameter. In one embodiment the DSP 104 further transforms the parametric data into a new format using a desired transformation prior to smoothing. This is done where the DSP 104 more accurately smoothes the voice data in this new format.

In step 226 the DSP 104 performs smoothing for each parameter using parameters in the eight prior and subsequent frames. The smoothing process includes first comparing the respective parameter value with the like parameter values from the eight prior and subsequent frames to determine if a discontinuity exists. If examination of the respective parameter with reference to the parameters in the eight prior and subsequent frames reveals that a discontinuity exists and that this discontinuity is likely an error, the smoothing process adjusts the parameter value to more closely match neighboring values. In one embodiment, the DSP 104 simply replaces this discontinuous value with a neighboring value.

As noted above, since the smoothing process is performed after the encoding operation has completed, parameters from a much larger number of prior and subsequent frames are available for each current parameter being smoothed. Therefore, if a discontinuity in one of the parameters is detected, the smoothing method of the present invention examines parameters from a greater number of prior and subsequent frames to perform enhanced smoothing of the parameters prior to decoding the parameters into speech signal waveforms. The ability to examine parameters in a greater number of prior and subsequent frames during the smoothing process provides more intelligent and more accurate smoothing of the respective parameters and thus provides enhanced speech signal quality.

In one embodiment of the invention, if the DSP 104 decides that an even greater number of parameters from additional prior and subsequent frames are deemed necessary to reach a decision in the smoothing process, the DSP 104 reads these additional parameters into the local memory 106 in order to perform more intelligent smoothing of that respective parameter.

In step 228 the DSP 104 transforms the smoothed parameters back into their original form, i.e., the form these parameters had prior to step 224. In step 230 the DSP 104 stores the smoothed parametric data back in the storage memory 112. In step 232 the DSP 104 determines if more parameter data remains in the storage memory 112 that has not yet been smoothed. If so, the DSP 104 repeats steps 222–230 for the next set of parameter data. If the smoothing process has been applied to all of the parameter data in the storage memory 112, then operation completes.

Smoothing Performed During Decoding

Figure 11:
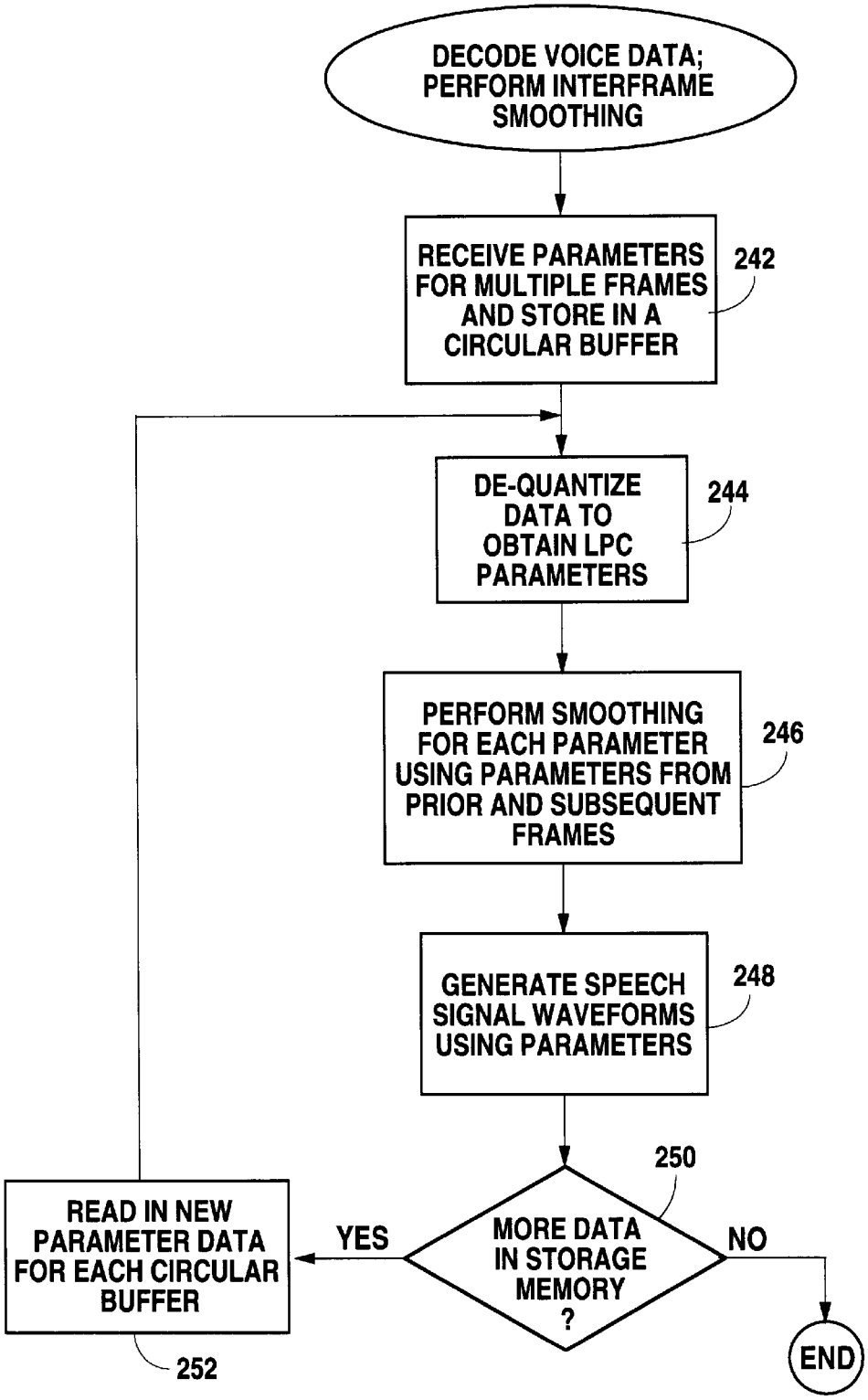
FIG. 11 is a flowchart diagram illustrating decoding of encoded parameters to generate speech waveform signals, wherein the decoding process includes an interframe smoothing process according to one embodiment of the invention.

Referring now to FIG. 11, a flowchart diagram illustrating the voice decoding process which includes interframe smoothing according to one embodiment of the present invention is shown. In step 242 the local memory 106 receives parameters for multiple frames and stores like parameters from each of the plurality of frames in respective circular buffers. In other words, as described above, all of the pitch parameters for each of the frames are stored in one circular buffer, the voice/unvoice parameters for each of the frames are stored in a second circular buffer, and so on. As mentioned above, parameters from seventeen frames are preferably stored in each circular buffer to allow the parameters from the eight prior and eight subsequent frames to be used for the smoothing process for each parameter. This allows much more accurate smoothing and allows for enhanced speech signal quality according to the present invention.

In step 244 the DSP 104 de-quantizes the data to obtain 1pc parameters. For more information on this step please see Gersho and Gray, *Vector Quantization and Signal Compression,* Kluwer Academic Publishers, which is hereby incorporated by reference in its entirety. In step 246 the DSP 104 performs smoothing for respective parameters in each circular buffer using parameters in the eight prior and subsequent frames. As noted above, the smoothing process comprises comparing the respective parameter value with like parameter values from neighboring frames. If a discontinuity exists, and the discontinuity is likely an error, the DSP 104 replaces the discontinuous parameter with a new value, preferably the value of a neighboring parameter. It is noted that steps of transforming the parameters into a more desirable form for smoothing and then transforming the smoothed parameters back into their original form after smoothing may also be performed. These steps would be similar to steps 224 and 228 of FIG. 10.

As stated above, since the smoothing process is performed after the encoding operation has completed, parameters from a much larger number of prior and subsequent frames are available for each current parameter being smoothed. Therefore, the smoothing method of the present invention examines parameters from a greater number of prior and subsequent frames to perform enhanced smoothing of the parameters prior to decoding the parameters into speech signal waveforms. The ability to examine parameters in a greater number of prior and subsequent frames during the smoothing process provides more intelligent and more accurate smoothing of the respective parameters and thus provides enhanced speech signal quality.

In one embodiment of the invention, as noted above, if the DSP 104 decides that parameters from a greater number of prior and subsequent frames are deemed necessary to reach a decision in the smoothing process, the DSP 104 reads additional parameters into the local memory 106 in order to perform more intelligent smoothing of that respective parameter. However, it is noted that this technique is limited when smoothing is being performed in real time during the decode process since retrieving additional parameters may impose an undesirable delay in generating speech waveforms.

Figure 1:
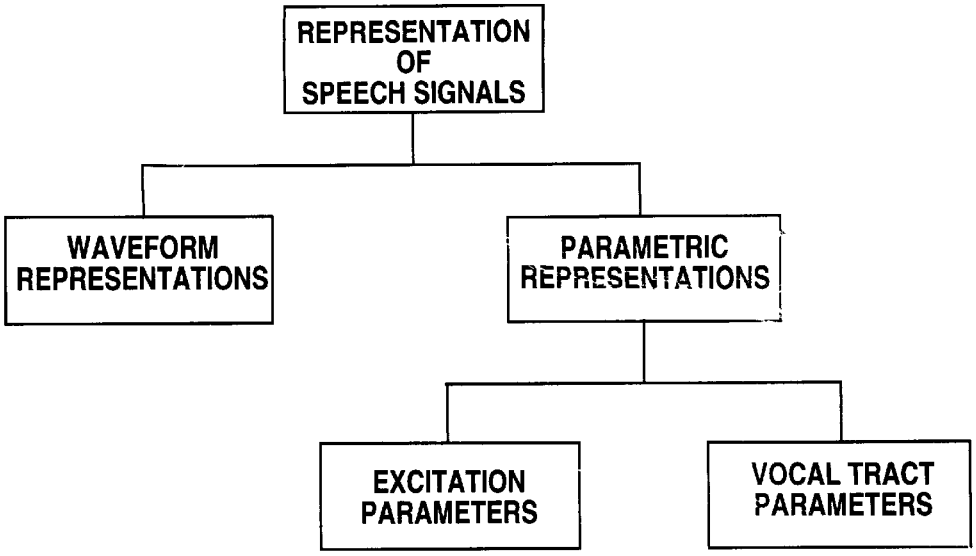
Fig. 1 (PRIOR ART)
FIG. 1 illustrates waveform representation and parametric representation methods used for representing speech signals.
Figure 2:
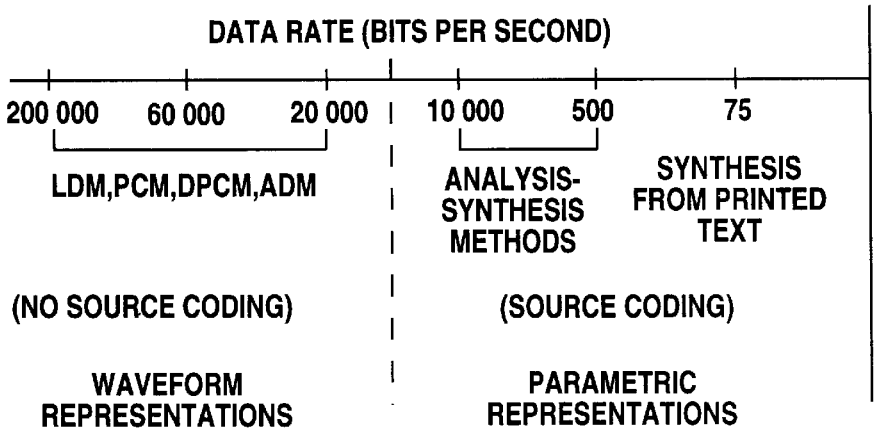
Fig. 2 (PRIOR ART)
FIG. 2 illustrates a range of bit rates for the speech representations illustrated in FIG. 1.
Figure 3:
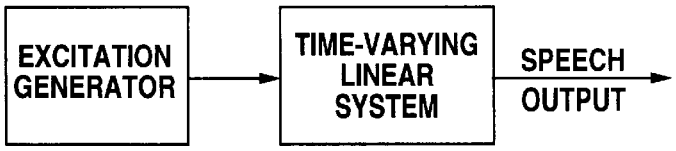
Fig. 3 (PRIOR ART)
FIG. 3 illustrates a basic model for speech production.
Figure 4:
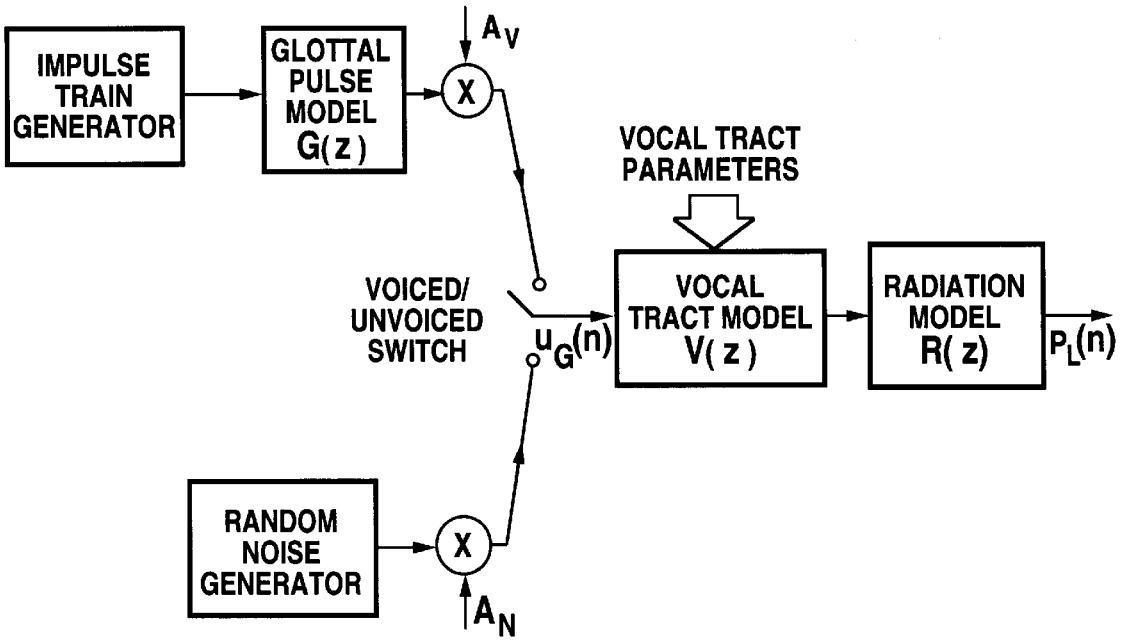
Fig. 4 (PRIOR ART)
FIG. 4 illustrates a generalized model for speech production.
Figure 5:
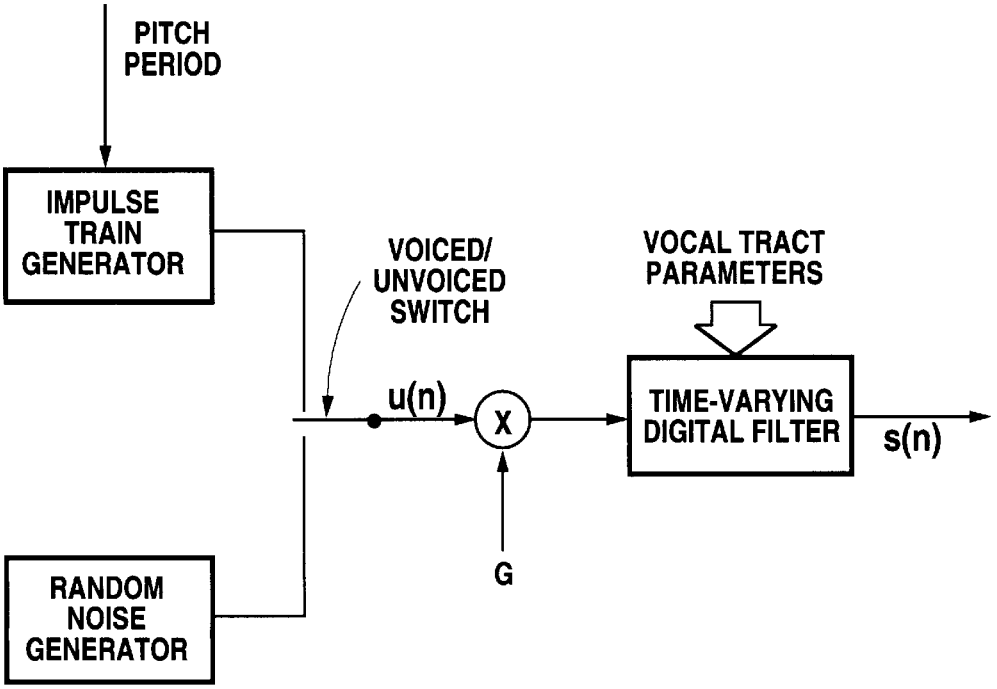
Fig. 5 (PRIOR ART)
FIG. 5 illustrates a model for speech production which includes a single time varying digital filter.

In step 248 the DSP 104 generates speech signal waveforms using the smoothed parameters. The speech signal waveforms are generated using a speech production model as shown in FIGS. 4 or 5. For more information on this step, please see Rabiner and Schafer, *Digital Processing of Speech Signals,* referenced above, which is incorporated herein by reference. In step 250 the DSP 104 determines if more parameter data remains to be decoded in the storage memory 112. If so, in step 252 the DSP 104 reads in a new parameter value for each circular buffer and returns to step 244. These new parameter values replace the least recent prior value in the respective circular buffers and thus allows the next parameter to be examined in the context of its neighboring parameters in the eight prior and subsequent frames. If no more parameter data remains to be decoded in the storage memory 112 in step 250, then operation completes.

In one embodiment of the present invention, during the smoothing process performed in either FIG. 10 or FIG. 11, only certain important parameters are maintained in circular buffers in the local memory 106 to reduce local memory requirements while allowing the DSP 104 easier access to these parameters. This embodiment is used when one or more of the parameter types are deemed to have greater relative importance and/or are more likely to experience severe discontinuities and hence erroneous parameter estimations than other parameters. For those parameters deemed to have greater relative importance or which are more likely to experience errors, a greater number of like parameters in neighboring frames are used during the smoothing process. Thus, these parameters are preferably maintained in circular buffers in the local memory 106 for ease of access. Those parameters which are less likely to have discontinuities and/or are less important require less parameters for smoothing, and these parameters are accessed as needed from the random access storage memory 112. In the preferred embodiment, the pitch and voicing parameters are maintained in the local memory 106 during the smoothing process for more efficient smoothing during the decoding process.

Examples of the Smoothing Process

When voice coding is being performed on the pitch parameter value, the pitch estimation will sometimes erroneously detect two times or one-half times or another multiple of the true value of the pitch. However, rarely in normal speech will the pitch of the human vocal cords change so substantially in 20 ms frames. Since a virtually unlimited number of prior and subsequent frames are available for smoothing analysis according to the present invention, the DSP 104 examines the pitch parameter from a plurality of prior and subsequent frames in order to perform more enhanced smoothing of the pitch parameter. This allows the DSP 104 to more accurately remove this error from the speech data prior to decoding the parameter data into speech waveforms.

Another parameter generated during the voice coding process is a voice/unvoice parameter indicating whether the current speech waveform is a voiced signal or unvoiced signal. As discussed in the background section, a voiced speech signal involves vibration of the vocal cords. An example of a voiced sound is "ahhh" where the vocal cords vibrate to produce the desired sound. An unvoiced signal does not involve vibration of the vocal cords, but rather involves forcing air out of a constriction in the vocal tract to produce a desired sound. An example of an unvoiced sound is "ssss." Here the vocal cords do not vibrate, but rather the sound is generated by forcing air through a constriction of the vocal tract at the mouth.

Most sounds in the English language are either voiced or unvoiced. However, some sounds, referred to as voiced fricatives, exhibit qualities of both, i.e., these sounds involve both vibration of the vocal cords and constriction of the vocal tract near the mouth to reduce air flow. An example of a speech sound which includes both voiced and s unvoiced components is "vvvv," where the sound is generated partially from vibration of the vocal cords and partially by expelling air through a constricted vocal tract. Sounds which have both voiced and unvoiced components require an impulse train generator to produce the voice component of the sound as well as random noise to produce the unvoiced portion of the sound.

In general, voicing parameter information can be represented by one binary value per frame, and it is undesirable to transmit more than one bit per frame indicative of whether a speech signal is voiced or unvoiced. Thus, for a voiced speech signal, the parameter for consecutive 20 ms frames would be voiced, voiced, voiced, voiced, voiced, etc. However, when a speech signal is being encoded which includes both voiced and unvoiced characteristics, the voicing estimation may determine that the speech waveform has a 50% voiced content. The voice estimator preferably then dithers the parameters for consecutive frames to appear as voiced, unvoiced, voiced, unvoiced, etc.

During smoothing of the voicing parameter, the smoothing process examines a plurality of prior and subsequent frames and detects the statistics of the underlying signal as being a combination of voiced and unvoiced sounds. For example, the smoothing process examines parameters from a plurality of prior and subsequent frames and determines that the current speech sound being decoded should comprise 75% unvoiced and 25% voiced speech. Alternatively, the smoothing process examines the statistics of the voiced/unvoiced parameters and detects that the current sounds being decoded should be 50% voiced and 50% unvoiced. Thus, in one embodiment the decoding process provides enhanced speech signal quality by controlling the excitation generator accordingly, i.e., by mixing the impulse train generator and random noise generator based on the detected percentages of voiced and unvoiced speech. Thus the decoder produces sounds with both voiced and unvoiced components much more accurately.

In one embodiment the smoothing process examines parameters from a large number of prior and subsequent frames to more accurately detect transitions between voiced speech, unvoiced speech, and speech having components of both voiced and unvoiced speech. This information is then used during decoding to reposition one or more frames to more accurately model the speech. For example, when the smoothing process detects that the voiced and unvoiced parameter statistics transition from 100% voiced to 75%/25% voiced/unvoiced to 50% voiced/unvoiced in consecutive frames, the process not only detects that speech sounds with both voiced and unvoiced components are required to be generated, but also more accurately detects the transition period between the voiced speech and the voiced/unvoiced speech. This information is used during the decoding process to generate enhanced and more realistic speech waveforms.

In the method of the present invention, the smoothing process is performed after the encoding process has completed and the parametric data has been stored in the storage memory 112. Where smoothing is performed on the voicing parameter as described above, smoothing is preferably performed during the decoding process since representation of a frame as, for example, 75% voiced 25% voiced, etc., requires more than 1 bit for the frame.

Therefore, the present invention essentially allows a single bit stream with one voiced/unvoiced bit per frame to provide an indication of not only whether the respective frame is a voiced sound or unvoiced sound, but rather analyzes the statistics of the voicing parameters in consecutive frames to provide enhanced speech quality. By analyzing the statistics of the voiced and unvoiced parameters of consecutive frames, the method accurately detects whether and by what percentage speech sounds comprise both voiced and unvoiced components and also more accurately detects the transitions between voiced, unvoiced, and voiced/unvoiced speech signals. It is noted that this is not possible in a standard real time environment because the decoder cannot analyze a sufficient number of frames without inserting an unacceptable delay.

Memory Storage Configurations

Figure 12:
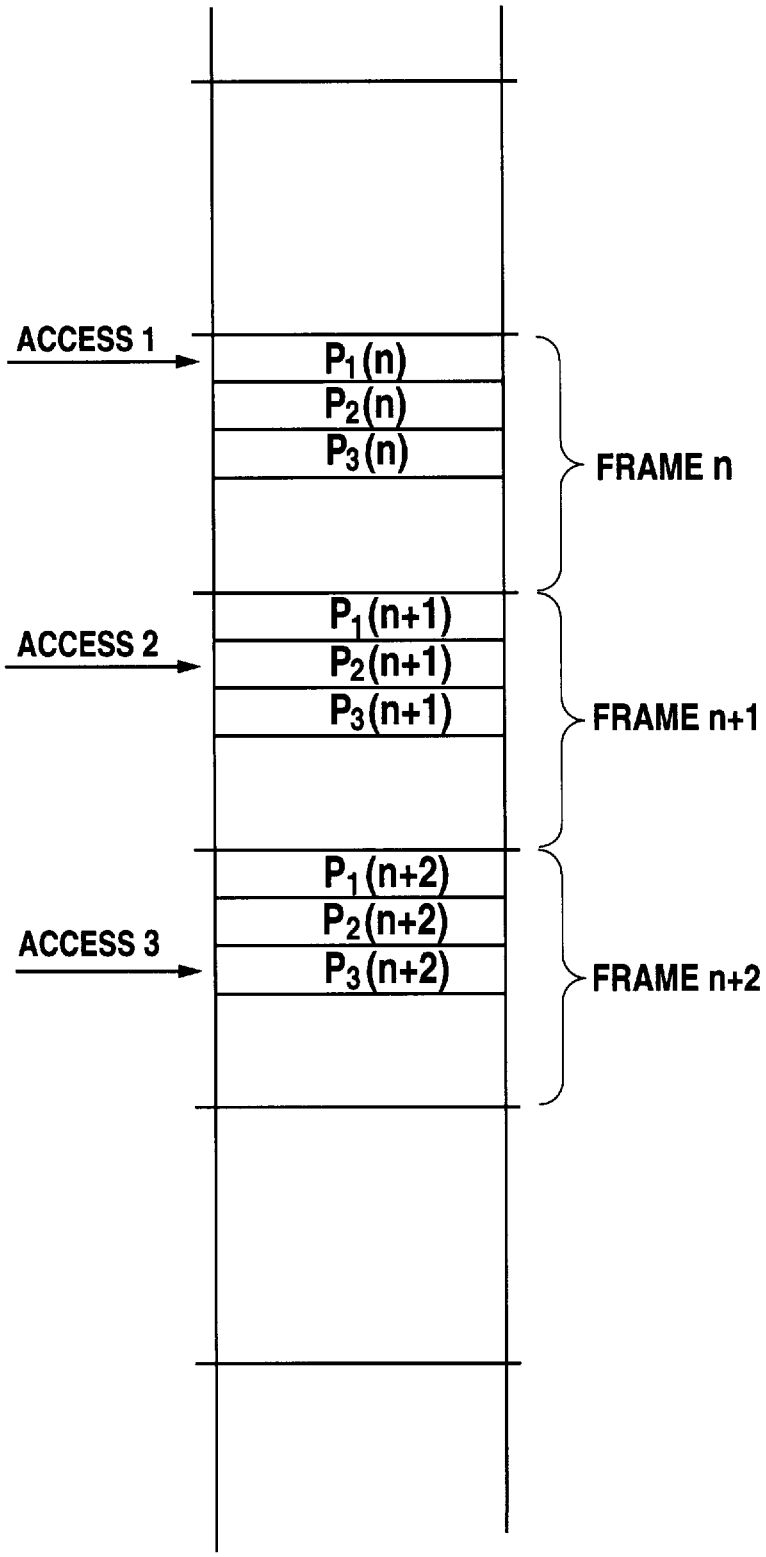
FIG. 12 illustrates parameter memory storage according to a multiple access, normal ordering method.

According to the invention, different parameter storage and accessing methods may be used to ensure that the DSP 104 receives the parameters from the storage memory 112 in the order necessary to perform interframe smoothing. FIG. 12 illustrates a configuration of the storage memory 112 according to one embodiment where the storage memory 112 is a random access storage memory, such as dynamic random access memory (DRAM). The memory storage configuration in FIG. 12 is referred to as normal ordering, whereby the parameters for each frame are stored contiguously in the memory sequentially according to the respective frame. Thus, for frame n, the parameters $P_1(n)$, $P_2(n)$, and $P_3(n)$, . . . are stored consecutively in the memory. The parameters for frame n+1 referred to as $P_1(n+1)$, $P_2(n+1)$, and $P_3(n+1)$ are stored consecutively after the parameters for frame n, and so forth. Where the storage memory 112 is a random access memory, and the DSP 104 is coupled to the storage memory 112 via a bus or demand serial link, the DSP 104 accesses any desired parameters in the storage memory 112. Thus, as shown in FIG. 12 when interframe smoothing is performed, the DSP 104 accesses like parameters from a plurality of consecutive frames for each respective circular buffer as described above.

FIG. 12 presumes that for each parameter a smoothing process is applied using parameters in a certain number of prior and subsequent frames. It is noted that a different number of prior frame parameters and subsequent frame parameters may be used in the smoothing process as desired. In the following example parameters from an equal number of prior and subsequent frames are used. In this example, for parameter $P_1$ a smoothing process is applied using parameters in a certain number $x_1$ of prior and $x_1$ subsequent frames, whereas the smoothing process performed on parameter $P_2$ uses parameters from $x_2$ prior and $x_2$ subsequent frames and smoothing is applied for parameter $P_3$ using parameters from $x_3$ prior and $x_3$ subsequent frames. Thus, the circular buffer for parameter PI is designed to store $2x_1+1$ $P_1$ parameters, the circular buffer for parameter $P_2$ is designed to store $2x_2+1$ $P_2$ parameters, and the circular buffer for parameter $P_3$ is designed to store $2x_3+1$ $P_3$ parameters. It is noted that at the beginning of the smoothing process when the circular buffers are initially loaded with parameters, a limited number of prior frames are available, i.e., frames are not available at time before zero. Thus, the parameters from these "non-existent" frames are set to nominal values. This is shown in FIG. 12, whereby in the frame prior to the current access point, the parameter $P_1$ (n−1) is not available, whereas parameters $P_2$ (n) and $P_3$ (n+1) are available. However, after a certain beginning number of parameters have been examined, the respective circular buffer will contain parameters from prior and subsequent frames.

After the circular buffers have been loaded, when the circular buffers for each of these parameters require a new value, the parameters are accessed from the storage memory 112. In the example decribed where $x_3$ is one greater than $x_2$ and $x_2$ is one greater than $x_1$, a parameter $P_1(n)$ is accessed for the circular buffer corresponding to parameter $P_1$, parameter $P_2(n+1)$ is accessed for the circular buffer corresponding to parameter $P_2$ and parameter $P_3(n+2)$ is accessed for the circular buffer corresponding to parameter $P_3$, as shown in FIG. 12. Therefore, the memory storage scheme shown in FIG. 12 assumes that frames of parameters are stored sequentially corresponding to the order in which speech data is received, and the DSP 104 randomly accesses desired parameters to fill the circular buffers during the smoothing process.

Figure 13:
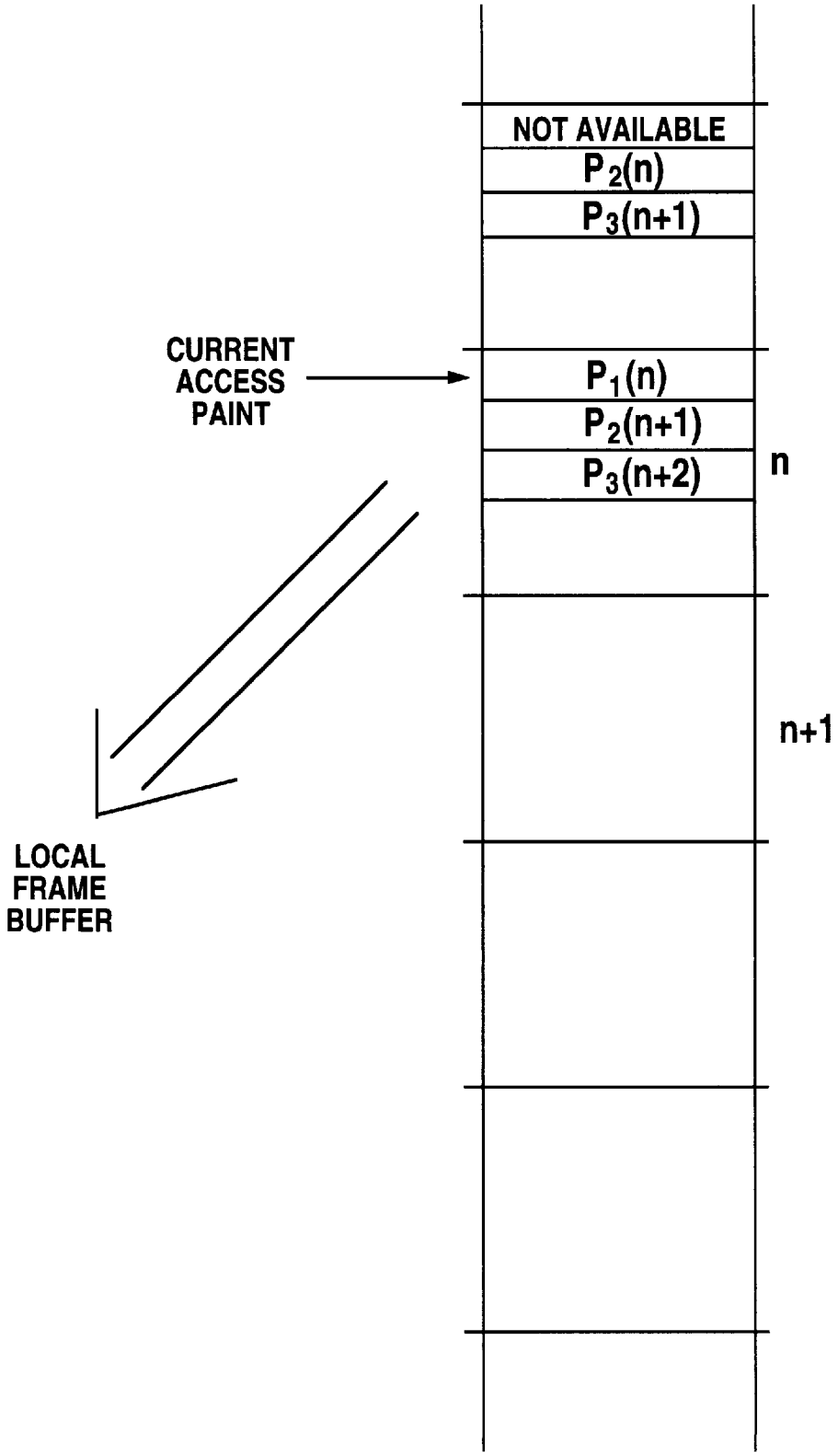
FIG. 13 illustrates parameter memory storage according to a single access, demand ordering method.

Referring now to FIG. 13, a different memory storage configuration referred to as demand ordering is shown. The memory configuration of FIG. 13 presumes a voice storage and retrieval system where the parameters in the storage memory 112 cannot be randomly accessed as in FIG. 12. In this embodiment, during the encoding process, the parameters generated by the DSP 104 are not stored consecutively as in FIG. 12, but rather are stored based on how these parameters are required to be accessed to perform the interframe smoothing process. Thus, instead of ordering the parameters by frame and accessing the parameters $P_1(n)$, $P_2(n+1)$ and $P_3(n+2)$ from non-consecutive locations as shown in FIG. 12, the parameters are "demand" ordered whereby the parameters $P_1(n)$, $P_2(n+1)$ and $P_3(n+2)$ are stored consecutively in the memory 112. It is noted that this embodiment requires that the local memory 106 queue the parameter values during the encoding process, so that the parameters are transferred to the storage memory 112 in the necessary order to store these parameters as shown in FIG. 13.

In an embodiment where the storage memory 112 is a random access memory and the DSP 104 randomly accesses any parameters from the storage memory 112, a normal ordering storage method is preferably used as shown in FIG. 12. In an embodiment where a demand serial link is used, such as that shown in FIG. 7, the normal ordering storage method of FIG. 12 is also preferably used. However, the storage method of FIG. 13 may be used in this embodiment as desired. Where a dumb serial link 130 is used between the DSP 104 and the storage memory 112, the storage method of FIG. 13 is preferably used.

Referring again to FIG. 7, if the serial link 130 is a dumb serial link, then during the encoding process of FIG. 8, the DSP 104 stores the parameters in the storage memory 112 based on the order that these parameters are required to be accessed by the DSP 104 during a subsequent smoothing process. As noted above, this requires that the local memory 106 queue the parameter values during the encoding process to enable the DSP 104 to transfer these parameters to the storage memory 112 in the necessary order. Alternatively, the parametric data may be stored in a normal ordering fashion as shown in FIG. 12. In this embodiment, as the DSP 104 reads the parameter data during the interframe smoothing process, this parameter data is queued in the local memory 106 and the parameters are then provided to the DSP 104 in the desired order for smoothing. Therefore, in an embodiment where a dumb serial link 130 is used, the voice coder/decoder 102 requires a sufficiently large local memory 106 to queue a potentially large number of parameter values regardless of the storage method used.

Conclusion

Therefore a system and method for storing and generating speech signals with enhanced quality using very low bit rate coders is shown and described. The system and method of the present invention performs a smoothing process after the parameter encoding has completed, where access to parameters in a greater number of prior and subsequent frames are available for the smoothing process. As noted above, the present invention may be applied to other systems that involve the storage and retrieval of parametric data, including video storage and retrieval systems, among others. The present invention may also be applied to real time data communication systems which have sufficient system bandwidth and processing power to store the parametric data and apply smoothing using a plurality of prior and subsequent frames during real time transmission.

Although the method and apparatus of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

We claim:

1. A method for storage and retrieval of digital voice data, comprising the steps of:

receiving input voice waveforms;

converting said input voice waveforms into digital voice data;

encoding said digital voice data into a plurality of parameters for each of a plurality of frames of said digital voice data;

storing said plurality of parameters in a storage memory;

reading said plurality of parameters from said storage memory after a conclusion of said steps of (a) receiving input voice waveforms, (b) converting said input voice waveforms, (c) encoding said digital voice data, and (d) storing said plurality of parameters in a storage memory; and smoothing said plurality of parameters to remove discontinuities from said plurality of parameters after said step of reading said plurality of parameters from said storage memory;

wherein, for one or more of said plurality of parameters, said step of smoothing comprises:

comparing a first parameter in a first frame with like parameters from a plurality of prior frames and a plurality of subsequent frames to determine if said first parameter varies from said like parameters from said plurality of prior frames and said plurality of subsequent frames; and replacing said first parameter with a new value if said step of comparing indicates that said first parameter varies from said like parameters from said plurality of prior frames and said plurality of subsequent frames.

2. The method of claim 1, wherein said step of smoothing produces a smoothed plurality of parameters, the method further comprising:

generating speech signal waveforms based on said smoothed plurality of parameters after said step of smoothing.

3. The method of claim 1, wherein said step of smoothing produces a smoothed plurality of parameters, the method further comprising:

storing said smoothed plurality of parameters in said storage memory after said step of smoothing.

4. The method of claim 3, further comprising:

reading said smoothed plurality of parameters from said storage memory after said step of storing said smoothed plurality of parameters; and generating speech signal waveforms based on said smoothed plurality of parameters after said step of reading said smoothed plurality of parameters from said storage memory.

5. The method of claim 1, wherein said step of comparing comprises comparing said first parameter in said first frame with like parameters from a plurality of prior consecutive frames and a plurality of subsequent consecutive frames.

6. The method of claim 5, wherein said step of comparing comprises comparing said first parameter in said first frame with like parameters from eight prior consecutive frames and eight subsequent consecutive frames.

7. The method of claim 1, wherein said step of smoothing further comprises:

reading additional like parameters from said storage memory after said step of comparing if said step of comparing indicates that said first parameter varies substantially from said parameters in said plurality of prior frames and said plurality of subsequent frames; and comparing said first parameter with said additional parameters read in said step of reading said additional parameters to determine if said first parameter varies substantially.

8. The method of claim 1, wherein said step of encoding generates a plurality of parameters of different types for each of said plurality of frames; and wherein said step of reading said plurality of parameters from said storage memory includes storing ones of said plurality of parameters in a plurality of buffers, wherein parameters of the same type from a plurality of said plurality of frames are stored in each of said plurality of buffers.

9. The method of claim 8, wherein, for each of said buffers, said step of smoothing comprises:

comparing a first parameter in a first buffer with other parameters in said first buffer to determine if said first parameter varies substantially from said other parameters in said first buffer; and replacing said first parameter with a new value if said step of comparing indicates that said first parameter varies substantially from said other parameters in said first buffer.

10. The method of claim 8, wherein said plurality of buffers have differing sizes for different types of parameters.

11. The method of claim 10, wherein said step of storing said plurality of parameters in said plurality of buffers comprises storing a first number of parameters of a first type in a first buffer and storing a second number of parameters of a second type in a second buffer, whereby said first number is different than said second number.

12. The method of claim 8, wherein said plurality of buffers comprise a plurality of circular buffers.

13. The method of claim 1, wherein said step of encoding generates a plurality of parameters of different types for each of said plurality of frames; and wherein said step of reading said plurality of parameters from said storage memory includes storing ones of said plurality of parameters in one or more buffers, wherein parameters of a first type are stored in a first buffer and parameters of a second type remain in said storage memory and are not stored in a buffer;

wherein said step of smoothing comprises:

comparing a first parameter of said first type in said first buffer with other parameters of said first type in said first buffer to determine if said first parameter varies substantially from said other parameters in said first buffer;

replacing said first parameter with a new value if said step of comparing indicates that said first parameter varies substantially from said other parameters in said first buffer;

reading parameters of said second type from said storage memory from a plurality of said plurality of frames;

comparing a first parameter of said parameters of said second type with other parameters of said second type;

replacing said first parameter of said parameters of said second type with a new value if said step of comparing indicates that said first parameter of said parameters of said second type varies substantially from other parameters of said second type.

14. The method of claim 1, wherein said step of encoding comprises generating a plurality of like parameters for a first type of parameter in one or more of said plurality of frames, the method further comprising:

performing intraframe smoothing on said plurality of like parameters of said first type for each of said one or more of said plurality of frames, wherein said step of performing intraframe smoothing generates a single parameter value of said first type based on said plurality of parameter values of said first type for each of one or more of said plurality of said frames.

15. The method of claim 1, further comprising:

transforming said plurality of parameters from a first form to a second form more suitable for smoothing, wherein said step of transforming is performed after said step of reading said plurality of parameters from said storage memory and prior to said step of smoothing said plurality of parameters;

transforming said smoothed plurality of parameters back to said first form after said step of smoothing said plurality of parameters; and storing said plurality of parameters in said storage memory after said step of transforming said smoothed plurality of parameters to said first form.

16. The method of claim 1, further comprising storing said digital voice data in a memory prior to said step of encoding, wherein said digital voice data can be partitioned into a plurality of frames of digital voice data.

17. A digital voice storage and retrieval system which provides enhanced speech quality, comprising:

a memory store;

a processor which receives input voice waveforms, generates a plurality of parameters representative of said input voice waveforms, and stores said plurality of parameters in said memory store, wherein said input voice waveforms can be partitioned into a plurality of frames and said processor generates said plurality of parameters for said plurality of frames of said input voice waveforms;

a local memory coupled to said processor for storing a first plurality of said plurality of parameters, wherein said first plurality of parameters includes a first parameter in a first frame being smoothed and like parameters from a plurality of prior and subsequent frames relative to said first frame;

wherein said processor reads said first plurality of parameters from said memory store and stores said first plurality of parameters in said local memory after a conclusion of (a) receiving the input voice waveforms, (b) generating the plurality of parameters, and (c) storing the plurality of parameters in said memory store;

wherein said processor performs a smoothing operation on said first plurality of parameters in said local memory after reading said first plurality of parameters from said memory store and storing said first plurality of parameters in said local memory, wherein said smoothing operation removes at least one discontinuity from said first plurality of parameters;

wherein said processor performs smoothing operations on said first parameter in said local memory using said like parameters from said plurality of prior and subsequent frames.

18. The digital voice storage and retrieval system of claim 17, wherein said processor generates speech signal waveforms based on said first plurality of parameters after performing said smoothing operation on said first plurality of parameters in said local memory.

19. The digital voice storage and retrieval system of claim 17, wherein said processor stores said smoothed first plurality of parameters in said storage memory after performing said smoothing operation on said first plurality of parameters in said local memory.

20. The digital voice storage and retrieval system of claim 19, wherein said processor generates speech signal waveforms based on said first plurality of parameters after performing said smoothing operation on said first plurality of parameters in said local memory and after said processor stores said smoothed first plurality of parameters in said storage memory.

21. The digital voice storage and retrieval system of claims 17, wherein said processor comprises:

means for comparing said first parameter in said first frame with said like parameters from said plurality of prior and subsequent frames to determine if said first parameter varies substantially from said like parameters from said plurality of prior and subsequent frames; and means for replacing said first parameter with a new value if said means for comparing determines that the said first parameter varies substantially from said like parameters from said plurality of prior and subsequent frames.

22. The digital voice storage and retrieval system of claim 21, wherein said processor reads additional like parameters from said memory store after operation of said means for comparing if said means for comparing determines that said first parameter varies substantially from said like parameters in said plurality of prior and subsequent frames; and wherein said means for comparing compares said first parameter with said additional like parameters to determine if said first parameter varies substantially.

23. The digital voice storage and retrieval system of claim 17, wherein said processor generates a plurality of parameters of different types for each of said plurality of frames of said voice input waveforms;

wherein said local memory includes a plurality of buffers corresponding to said parameters of different types;

wherein said processor reads said parameters from said memory store and stores said parameters of the same type in said buffers in said local memory.

24. The digital voice storage and retrieval system of claim 23, wherein said plurality of buffers have differing sizes for different types of parameters.

25. A method for storage and retrieval of digital parametric data, comprising the steps of:

receiving input digital data;

encoding said digital data into a plurality of parameters for each of a plurality of frames of said digital data;

storing said plurality of parameters in a storage memory;

reading said plurality of parameters from said storage memory after a conclusion of said steps of (a) receiving input digital data, (b) encoding said digital data, and (c) storing said plurality of parameters in a storage memory; and smoothing said plurality of parameters to remove discontinuities from said plurality of parameters after said step of reading said plurality of parameters from said storage memory;

wherein said smoothing comprises:

comparing a first parameter in a first frame with like parameters from a plurality of prior frames and a plurality of subsequent frames to determine if said first parameter varies from said like parameters from said plurality of prior frames and said plurality of subsequent frames; and replacing said first parameter with a new value if said step of comparing indicates that said first parameter varies from said like parameters from said plurality of prior frames and said plurality of subsequent frames.

26. The method of claim 25, wherein said step of smoothing produces a smoothed plurality of parameters, the method further comprising:

storing said smoothed plurality of parameters in said storage memory after said step of smoothing.

27. The method of claims 25, wherein said step of smoothing further comprises:

reading additional like parameters from said storage memory after said step of comparing if said step of comparing indicates that said first parameter varies substantially from said like parameters in said plurality of prior frames and said plurality of subsequent frames; and comparing said first parameter with said additional like parameters read in said step of reading said additional parameters to determine if said first parameter varies substantially.

28. The method of claim 25, wherein said step of encoding generates a plurality of parameters of different types for each of said plurality of frames; and wherein said step of reading said plurality of parameters from said storage memory includes storing ones of said plurality of parameters in a plurality of buffers, wherein parameters of the same type from a plurality of said plurality of frames are stored in each of said plurality of buffers.

29. The method of claim 28, wherein said plurality of buffers have differing sizes for different types of parameters.

30. The method of claim 29, wherein said step of storing said plurality of parameters in said plurality of buffers comprises storing a first number of parameters of a first type in a first buffer and storing a second number of parameters of a second type in a second buffer, whereby said first number is different than said second number.

31. The method of claim 28, wherein said plurality of buffers comprise a plurality of circular buffers.

32. The method of claim 25, wherein said step of encoding generates a plurality of parameters of different types for each of said plurality of frames; and wherein said step of reading said plurality of parameters from said storage memory includes storing ones of said plurality of parameters in one or more buffers, wherein parameters of a first type are stored in a first buffer and parameters of a second type remain in said storage memory and are not stored in a buffer;

wherein said step of smoothing comprises:

comparing a first parameter of said first type in said first buffer with other parameters of said first type in said first buffer to determine if said first parameter varies substantially from said other parameters in said first buffer;

replacing said first parameter with a new value if said step of comparing indicates that said first parameter varies substantially from said other parameters in said first buffer;

reading parameters of said second type from said storage memory from a plurality of said plurality of frames;

comparing a first parameter of said parameters of said second type with other parameters of said second type;

replacing said first parameter of said parameters of said second type with a new value if said step of comparing indicates that said first parameter of said parameters of said second type varies substantially from other parameters of said second type.

33. The method of claim 25, wherein said step of encoding comprises generating a plurality of like parameters for a first type of parameter in one or more of said plurality of frames, the method further comprising:

performing intraframe smoothing on said plurality of like parameters of said first type for each of said one or more of said plurality of frames, wherein said step of performing intraframe smoothing generates a single parameter value of said first type based on said plurality of parameter values of said first type for each of one or more of said plurality of said frames.

34. The method of claim 25, further comprising:

transforming said plurality of parameters from a first form to a second form more suitable for smoothing, wherein said step of transforming is performed after said step of reading said plurality of parameters from said storage memory and prior to said step of smoothing said plurality of parameters;

transforming said smoothed plurality of parameters back to said first form after said step of smoothing said plurality of parameters; and storing said plurality of parameters in said storage memory after said step of transforming said smoothed plurality of parameters to said first form.

35. The method of claim 25, wherein said input digital data comprises voice data.

36. The method of claim 25, wherein said input digital data comprises video data.

37. A digital data storage and retrieval system which provides enhanced speech quality, comprising:

a processor which receives input digital data and generates a plurality of parameters representative of said input digital data, wherein said input digital data can be partitioned into a plurality of frames and said processor generates said plurality of parameters for said plurality of frames of said input digital data;

a memory store coupled to said processor for storing said plurality of parameters;

a local memory coupled to said processor for storing a first plurality of said plurality of parameters, wherein said first plurality of parameters includes a first parameter in a first frame being smoothed and like parameters from a plurality of prior and subsequent frames relative to said first frame;

wherein said processor reads said first plurality of parameters from said memory store and stores said first plurality of parameters in said local memory;

wherein said processor performs a smoothing operation on said first parameter in said local memory after reading said first plurality of parameters from said memory store and storing said first plurality of parameters in said local memory;

wherein said processor performs said smoothing operation on said first parameter in said local memory using said like parameters from said plurality of prior and subsequent frames.

38. The digital data storage and retrieval system of claim 37, wherein said processor stores said smoothed first plurality of parameters in said storage memory after performing said smoothing operation on said first plurality of parameters in said local memory.

39. The digital data storage and retrieval system of claim 37, wherein said processor comprises:

means for comparing said first parameter in said first frame with said like parameters from said plurality of prior and subsequent frames to determine if said first parameter varies substantially from said like parameters from said plurality of prior and subsequent frames; and means for replacing said first parameter with a new value if said means for comparing determines that said first parameter varies substantially from said like parameters from said plurality of prior and subsequent frames.

40. The digital data storage and retrieval system of claim 37, wherein said processor reads additional like parameters from said memory store after operation of said means for comparing if said means for comparing determines that said first parameter varies substantially from said like parameters in said plurality of prior and subsequent frames; and wherein said means for comparing compares said first parameter with said additional like parameters to determine if said first parameter varies substantially.

41. The digital data storage and retrieval system of claim 37, wherein said processor generates a plurality of parameters of different types for each of said plurality of frames of said input digital data;

wherein said local memory includes a plurality of buffers corresponding to said parameters of different types;

wherein said processor reads said parameters from said memory store and stores said parameters of the same type in said buffers in said local memory.

42. The digital data storage and retrieval system of claim 41, wherein said plurality of buffers have differing sizes for different types of parameters.

43. The digital data storage and retrieval system of claim 37, wherein said input digital data comprises voice data.

44. The digital data storage and retrieval system of claim 37, wherein said input digital data comprises video data.

* * * * *